US007179999B2

(12) United States Patent
Clark et al.

(10) Patent No.: US 7,179,999 B2
(45) **Date of Patent: *Feb. 20, 2007**

(54) MULTI-PAIR DATA CABLE WITH CONFIGURABLE CORE FILLING AND PAIR SEPARATION

(75) Inventors: William T. Clark, Lancaster, MA (US); Joseph Dellagala, Shrewsbury, MA (US); Kenneth Consalvo, Leominster, MA (US)

(73) Assignee: Belden Technologies, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/352,850

(22) Filed: Feb. 13, 2006

(65) Prior Publication Data

US 2006/0124344 A1 Jun. 15, 2006

Related U.S. Application Data

(63) Continuation of application No. 10/336,535, filed on Jan. 3, 2003, now Pat. No. 6,998,537, which is a continuation of application No. 09/853,512, filed on May 11, 2001, now Pat. No. 6,570,095, which is a continuation of application No. 09/257,844, filed on Feb. 25, 1999, now Pat. No. 6,248,954.

(51) Int. Cl.
*H01B 11/02* (2006.01)

(52) U.S. Cl. ..... 174/113 R; 174/113 C

(58) Field of Classification Search ..... 174/113 R, 174/113 C, 131 A

See application file for complete search history.

(56) References Cited

U.S. PATENT DOCUMENTS

| | | | |
|---|---|---|---|
| 483,285 | A | 9/1892 | Guilleaume |
| 1,883,269 | A | 10/1932 | Yonkers |
| 1,976,847 | A | 10/1934 | Gordon et al. |
| 2,538,019 | A | 1/1951 | Lee |
| 3,622,683 | A | 11/1971 | Roberts et al. |
| 3,649,744 | A | 3/1972 | Coleman |

(Continued)

FOREIGN PATENT DOCUMENTS

| | | | |
|---|---|---|---|
| DE | 697378 | C | 12/1940 |

(Continued)

OTHER PUBLICATIONS

C&M Corporation, the "Engineering Design Guide," 3rd edition , p. 11, 1992.

*Primary Examiner*—Chau Nguyen N.
(74) *Attorney, Agent, or Firm*—Lowrie, Lando & Anastasi, LLP.

(57) ABSTRACT

An improved twisted pair telecommunications cable according to the invention includes a plurality of twisted pairs of insulated conductors, and a substantially flat configurable pair separator disposed between the plurality of twisted pairs of insulated conductors along a longitudinal length of the telecommunications cable. The twisted pair communications cable also includes a jacket assembly enclosing the plurality of twisted pairs of insulated conductors and the substantially flat pair separator. The substantially flat pair separator separates each twisted pair of insulated conductors from every other twisted pair of insulated conductors with a spacing sufficient to provide a desired crosstalk isolation between each of the plurality of twisted pairs of insulated conductors.

20 Claims, 8 Drawing Sheets

U.S. PATENT DOCUMENTS 3,819,443 A 6/1974 Simons et al.
3,881,052 A 4/1975 Britz et al.
3,911,200 A * 10/1975 Simons et al. ..... 174/36
4,034,148 A 7/1977 Lang
4,319,940 A 3/1982 Arrovo et al.
4,406,914 A 9/1983 Kincaid
4,487,992 A 12/1984 Tomita
4,500,748 A 2/1985 Klein
4,595,793 A 6/1986 Arrovo et al.
4,605,818 A 8/1986 Arrovo et al.
4,647,714 A 3/1987 Goto
4,697,051 A 9/1987 Beggs et al.
4,767,891 A 8/1988 Biegon et al.
4,777,325 A 10/1988 Siwinski
4,788,088 A 11/1988 Kohl
4,800,236 A 1/1989 Lemke
4,912,283 A 3/1990 O'Connor
5,037,999 A 8/1991 VanDeusen
5,132,488 A 7/1992 Tessier et al.
5,173,961 A 12/1992 Chiasson
5,253,317 A 10/1993 Allen et al.
5,298,680 A 3/1994 Kenny
5,393,933 A 2/1995 Goertz
5,399,813 A 3/1995 McNeill et al.
5,424,491 A 6/1995 Walling
5,493,071 A 2/1996 Newmoyer
5,514,837 A 5/1996 Kenny et al.
5,563,377 A * 10/1996 Arpin et al. ..... 174/121 A
5,789,711 A 8/1998 Gaeris et al.
5,900,588 A 5/1999 Springer et al.
5,952,615 A 9/1999 Prudhon
5,969,295 A * 10/1999 Boucino et al. ..... 174/113 C
6,037,546 A 3/2000 Mottine et al.
6,194,663 B1 2/2001 Friesen et al.
6,248,954 B1 6/2001 Clark et al.
6,255,593 B1 7/2001 Reede
6,288,340 B1 9/2001 Arnould
6,392,152 B1 * 5/2002 Mottine et al. ..... 174/110 PM
6,462,268 B1 10/2002 Hazy et al.
6,570,095 B2 5/2003 Clark et al.
6,770,819 B2 8/2004 Patel
6,998,537 B2 * 2/2006 Clark et al. ..... 174/113 R
2002/0096358 A1 7/2002 Murakami et al.
2003/0106704 A1 6/2003 Isley et al.
2004/0050578 A1 3/2004 Hudson
2004/0118593 A1 6/2004 Augustine et al.
2005/0087361 A1 4/2005 Hayes et al.
2006/0059883 A1 3/2006 Hopkinson et al.

FOREIGN PATENT DOCUMENTS

DE 90 11 484 U 10/1990
DE 90 11 484 * 11/1990
EP 1 085 530 A2 3/2001
FR 694100 A 11/1930
WO WO 2000/51142 8/2000
WO WO 2001/54142 A 7/2001
WO WO 2005/041219 A1 5/2005

* cited by examiner

MULTI-PAIR DATA CABLE WITH CONFIGURABLE CORE FILLING AND PAIR SEPARATION

RELATED APPLICATIONS

This application is a continuation of and claims the benefit under 35 U.S.C. §120 to pending U.S. patent application Ser. No. 10/336,535, filed Jan. 3, 2003 now U.S. Pat. No. 6,998,537, entitled "Multi-Pair Data Cable with Configurable Core Filling and Pair Separation," which is a continuation of and claims the benefit under 35 U.S.C. §120 of U.S. patent application Ser. No. 09/853,512, filed May 11, 2001 now U.S. Pat. No. 6,570,095, entitled "Multi-Pair Data Cable with Configurable Core Filling and Pair Separation," which is a continuation of and claims the benefit under 35 U.S.C. §120 of U.S. patent application Ser. No. 09/257,844, now U.S. Pat. No. 6,248,954 B1, entitled, "Multi-Pair Data Cable with Configurable Core Filling and Pair Separation," filed Feb. 25, 1999, all of which which are hereby incorporated herein by reference in their entireties.

FIELD OF THE INVENTION

The present invention relates to high-speed data communications cables using at least two twisted pairs of insulated conductors. More particularly, the invention relates to high-speed data communications cables having a light-weight, configurable core-filling isolation pair separator that provides geometrical separation between the twisted pairs of insulated conductors.

DISCUSSION OF THE RELATED ART

High-speed data communications media in current usage include pairs of insulated conductors twisted together to form a balanced transmission line. Such pairs of insulated conductors are referred to herein as "twisted pairs." When twisted pairs are closely placed, such as in a cable, electrical energy may be transferred from one twisted pair of a cable to another twisted pair. Such energy transferred between twisted pairs is referred to as crosstalk. As operating frequencies increase, improved crosstalk isolation between the twisted pairs becomes more critical.

The Telecommunications Industry Association and the Electronics Industry Association (TIA/EIA) have developed standards which specify specific categories of performance for cable impedance, attenuation, skew and particularly crosstalk isolation. One standard for crosstalk or, in particular, crosstalk isolation, is TIA/EIA-568-A, wherein a category 5 cable is required to have 38 dB of isolation between the twisted pairs at 100 MHz and a category 6 cable is required to have 42 dB of isolation between the twisted pairs at 100 MHz. Various cable design techniques have been used to date in order to try to reduce crosstalk and to attempt to meet the industry standards.

For example, one cable implementation known in the industry that has been manufactured and sold as a high-speed data communications cable, includes the twisted pairs formed with relatively tight twists, and the cable is formed into a round construction. In this conventional cable, each twisted pair has a specified distance between twists along a longitudinal direction of the twisted pair, that distance being referred to as the "twist lay." When adjacent twisted pairs have the same twist lay and/or twist direction, they tend to lie within a cable more closely spaced than when the twisted pairs have different twist lays and/or a different twist direction. Such close spacing increases the amount of undesirable crosstalk which occurs between the twisted pairs. In some conventional cables, each twisted pair within the cable has a unique twist lay in order to increase the spacing between pairs and thereby to reduce the crosstalk between twisted pairs of the cable. In addition, the twist direction of the twisted pairs may also be varied. However, this industry standard configuration can only achieve limited crosstalk isolation.

Another cable implementation 100 disclosed in U.S. Pat. No. 4,777,325, is illustrated in FIG. 1, wherein the twisted pairs are enclosed within a jacket 102 that has a wide, flat configuration. In particular, a plurality of twisted pairs 104*a*–104*b*, 106*a*–106*b*, 108*a*–108*b*, and 110*a*–110*b* are positioned side-by-side, each in separate compartments 112, 114, 116, and 118 formed within a flat hollow envelope of an extruded outer sheath 120. The cable is provided with separator ribs 122 between a top and a bottom of the sheath to divide the outer sheath into the separate compartments and to prevent lateral movement of the twisted pairs out of their respective compartments. However, one problem with this flat configuration for a cable is that it has limited flexibility as compared to that of a round cable, which hinders installation of the cable in conduits and around bends.

Another cable implementation which addresses the problem of twisted pairs lying too closely together within the cable is described, for example, in U.S. Pat. No. 5,789,711 and is illustrated in FIG. 2. In particular, the cable includes, for example, four twisted pairs 124 disposed about a central pre-shaped support 126, wherein the support positions a twisted pair within grooves or channels 128 formed by the support. In particular, the support provides the grooves or channels which keep the twisted pairs at fixed positions with respect to each other. The support can have any of a number of shapes, including, for example, a standard "X", a "+", or the separator as is illustrated in FIG. 2. The prongs or protrusions 130 of the support preserve the geometry of the pairs relative to each other, which helps reduce and stabilize crosstalk between the twisted pairs. However, some problems with the support is that the support adds cost to the cable, may limit the flexibility of the cable and increases the size; e.g., the diameter, of the cable. Another problem may be that the material which forms the support may result in the overall cable being a potential fire and/or smoke hazard.

Still another known industry cable implementation 132 is illustrated in FIG. 3. The cable utilizes a jacket 134 with inward protrusions 136 that form channels 138 within the cable. A twisted pair 140 of conductors 142, 144 is disposed within each channel. The protrusions are used to provide adequate pair separation. However, one problem with these protrusions is that they can be difficult to manufacture. In addition, the protrusions may not provide adequate separation between the twisted pairs where the stability of the protrusions is difficult to provide, and thus performance repeatability of the cable is an issue. Further, another problem is that the jacket is not easily strippable. When the cable is to be stripped by removing the outer jacket, which is often done with a sharp device such as, for example, a razor, the protrusions will not be cut by the incision around the circumference of the jacket and will have to be broken off separately in order to remove the jacket.

Accordingly, some of the problems with the above known configurations are that they are expensive, difficult to use, are generally undesirably large, and have decreased flexibility of the cables and workability of the twisted pairs of wires.

SUMMARY OF THE INVENTION

Therefore, a need exists for a high-speed data cable having multiple twisted pair wires with desired crosstalk performance, improved handling and termination capabilities, that is inexpensive, flexible and has a desired size. This invention provides an improved data cable.

According to the invention, a data communications cable has been developed so as to better facilitate the cable for its the intended use of high speed data transmission, yet maintain a form factor that has desired flexibility and workability, and that is compatible with industry standard hardware, such as plugs and jacks. The data communications cable of the invention has the additional benefit of a reduced cabled size relative to other known cables within its performance class.

In particular, the present invention provides these advantages by utilizing a substantially flat configurable, highly flexible, core-filling, dielectric separator to provide twisted pair separation for the cable.

One embodiment of a data communications cable of the invention includes a first twisted pair of insulated conductors, a second twisted pair of insulated conductors, and the substantially flat dielectric pair separator. The substantially flat configurable dielectric pair separator is disposed between the first twisted pair of insulated conductors and the second twisted pair of insulated conductors. The data communications cable also includes a jacket assembly enclosing the first twisted pair of insulated conductors, the second twisted pair of insulated conductors, and the substantially flat dielectric pair separator.

With this arrangement, the data communications cable can be made with desired crosstalk isolation between the twisted pairs of insulated conductors. In addition, due to the conforming nature and the desired thickness of the substantially flat configurable dielectric pair separator, the cable has desired flexibility, workability and size. Moreover, these advantages do not come at the expense of other properties of the cable such as, for example, size or reduced impedance stability. The substantially flat configurable dielectric pair separator also facilitates termination of the data communications cable to known industry standard hardware.

BRIEF DESCRIPTION OF THE DRAWINGS

The objects, features and advantages of the present invention will become more apparent in view of the following detailed description of the invention when taken in conjunction with the figures, in which.

DETAILED DESCRIPTION

A number of embodiments of a data communications cable according to the invention will now be described in which the cable is constructed with a plurality of twisted pairs of insulated conductors and a core made from a configurable, dielectric pair separator. However, it is to be appreciated that the invention is not limited to any number of twisted pairs or any profile for the configurable, dielectric pair separator illustrated in any of these embodiments. The inventive principles can be applied to cables including greater or fewer numbers of twisted pairs and having different core profiles of the configurable dielectric pair separator. In addition, although these embodiments of the invention are described and illustrated in connection with twisted pair data communication media, it is to be appreciated that other high-speed data communication media can be used instead of twisted pairs of conductors in the constructions of the cable according to the invention, such as, for example, fiber optic media.

Figure 4:
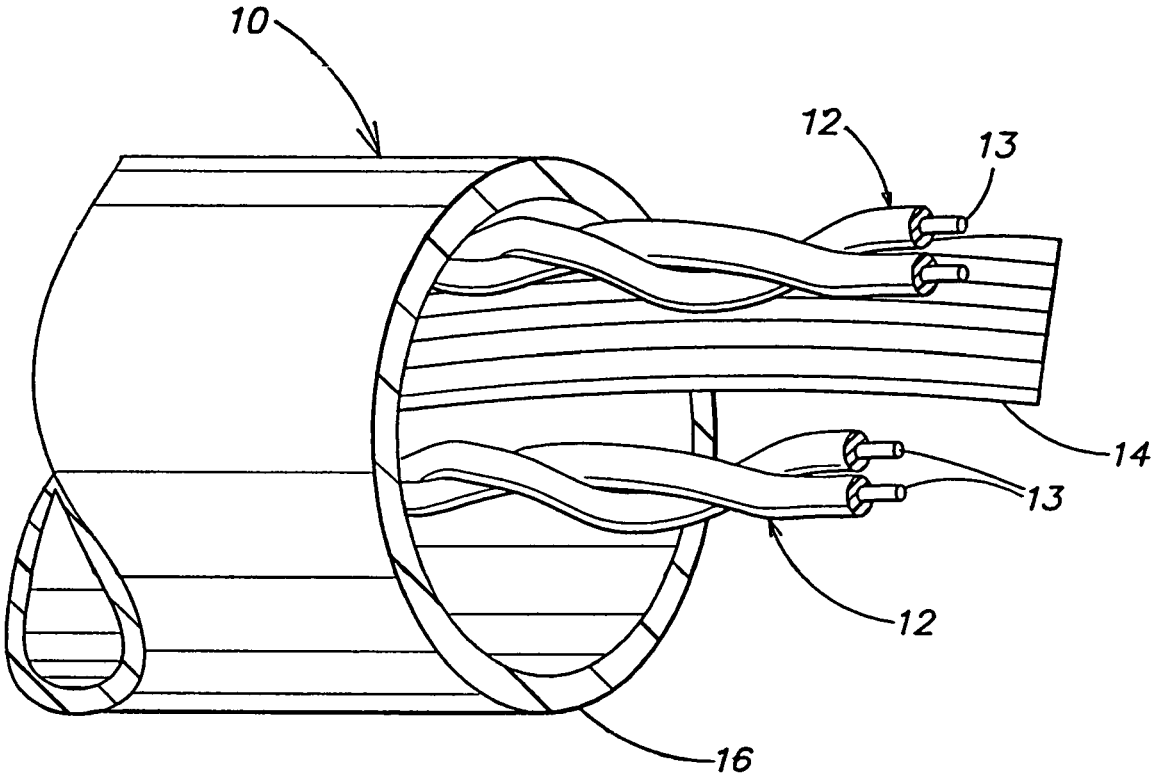
FIG. 4 is a perspective view of a data communications cable according to one embodiment of the invention.

FIG. 4 depicts an embodiment of a data communications cable 10 according to the present invention. The cable 10 includes two twisted pairs 12 of insulated conductors 13. The twisted pairs 12 are separated by a low dielectric constant, low dissipation factor, polymer "pair separator" 14. The twisted pairs 12 and the pair separator 14 are encased within a jacket assembly 16. The outer jacket can be a PVC, a low-smoke, low-flame PVC, or any plenum or non-plenum rated thermoplastic.

Figure 5:
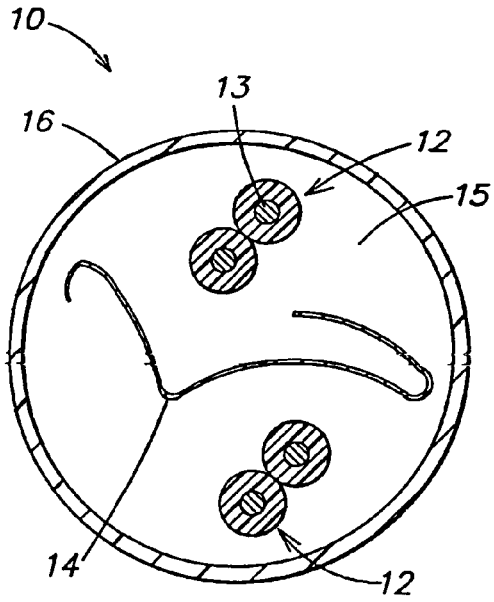
FIG. 5 is a cross-sectional view of the embodiment of the data communications cable of FIG. 4.

FIG. 5 depicts a cross-sectional view of an embodiment of the cable of FIG. 4. The configurable pair separator 14 runs along a longitudinal length of the cable, and is configured such that the twisted pairs are disposed within channels or grooves 15 of the pair separator along the length of the cable. As illustrated, the grooves 15 do not form completely enclosed channels. Some of the advantages of this cable according to the invention are that the pair separator provides structural stability during manufacture and use of the data communications cable, yet does not degrade the flexibility and workability of the cable, and does not substantially increase the size of the cable. In addition, the pair separator improves the crosstalk isolation between the twisted pairs by providing desired spacing between the twisted pairs. Therefore, the configurable pair separator of the invention lessens the need for complex and hard to control twist lay procedures, core filling arrangements and jacket embodiments described above with respect to the related art.

The above-described embodiment of the data communications cable can be constructed using a number of different materials as the pair separator 14. While the invention is not limited to the materials described herein, the invention is advantageously practiced using these materials. In particular, the configurable pair separator is preferably a flame-retardant, low-dielectric constant, low-dissipation factor, foamed polymer tape, such as, for example, a foamed flame retardant, cellular polyolefin or fluoropolymer like NEPTC PP500 "SuperBulk", a foamed fluorinated ethylene propylene (FEP) or a foamed polyvinyl chloride (PVC). The above-described pair separators are preferably used in a non-plenum rated application where the cable is not required to pass industry standard flame and smoke tests such as the Underwriters Laboratories (UL) 910 test. Another preferable configurable pair separator is a woven fiberglass tape normally used as a binder for cables, such as, for example, Allied Fluoroglass CTX3X50. This woven fiberglass binder is preferably used in a plenum rated application where the cable must satisfy the UL 910 test.

Figure 13A:
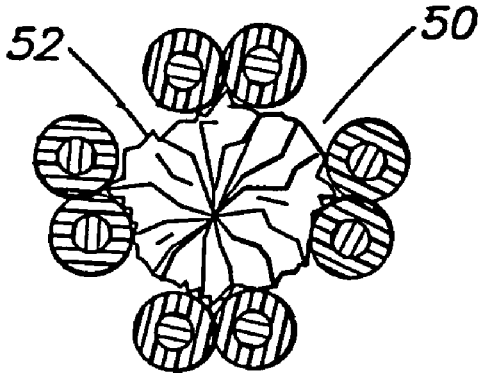
FIG. 13A illustrates a core of a four twisted pair cable.
Figure 13B:
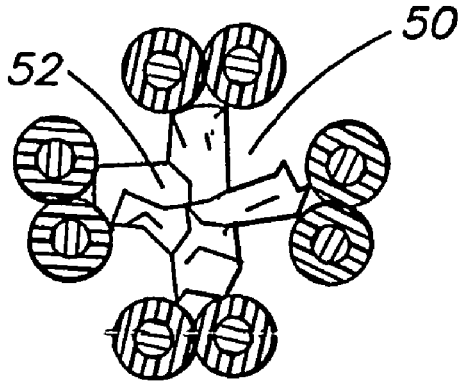
FIG. 13B is an exploded view of the core of the cable of FIG. 13A, having a filler material according to the invention.

Still another pair separator material that may be used in the cable of the invention is a bulk filling material such as a polyolefin or glass fiber filler that is flame-retardant and is typically shredded or fibrulated, but may also be solid, such as, for example, Chadwick AFT 033 Fiberglass. Such a bulk filling material is typically twisted up and used as a filling material in a core of the cable, with no other purpose. In particular, referring to FIG. 13A, the bulk filler is typically used as a core filling material that fills 100% of the core area 50 between the illustrated four twisted pair, that is used to keep the cable in a more or less round construction. However, referring to FIG. 13B, according to the present invention it is preferable to provide less than 100% of the core area 50 with the filling material; and it is more preferable us use less than 42% of the core with the filler material 52 for providing isolation between the twisted pairs. In a preferred embodiment, approximately 32% of the overall core area between the four twisted pairs of the cable is filled with such a filler and shaped as described herein. Therefore, one aspect of the present invention is the recognition that the filler or tape described above can be used to prevent physical contact between opposite and adjacent twisted pairs, thereby increasing the isolation between the twisted pairs, while not requiring the entire core area be filled, and therefore not sacrificing the size, cost or flexibility of the overall cable.

Figure 6:
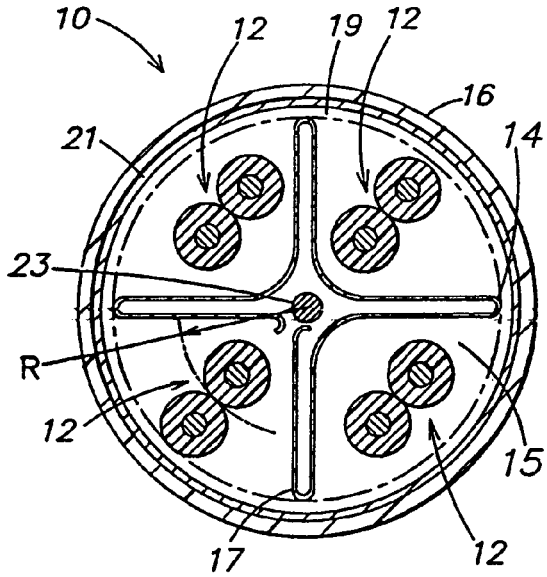
FIG. 6 is a cross-sectional view of a data communications cable according to another embodiment of the invention.

FIG. 6 depicts a cross-sectional view of a preferred embodiment of the data cable 10 of this invention. The cable includes the low-dielectric constant, low-dissipation factor polymer pair separator 14 formed into a cable core in such a way as to physically separate the four twisted pairs 12, thereby decreasing field coupling between the twisted pairs, providing a desired opposite twisted pair-to-pair physical distance, as well as providing a desired adjacent pair separation. It is to be appreciated that like components of the data communications cable illustrated in FIGS. 4–5 have been provided with like reference numbers and the description of these components applies with respect to each of the cable embodiments to be described herein.

In the embodiment of the cable of FIG. 6, the pair separator 14 is a flat configurable tape used as a core filler, that is shaped to have the illustrated profile and that is provided in the cable between the four twisted pairs 12. In particular, in this embodiment, the configured pair separator has a shape somewhat like a "+", providing four channels 15 between each pair of protrusions 17 formed by the pair separator. Each channel carries one twisted pair 12 that is placed within the channel during a process of manufacturing the cable that will be described in further detail below. As is discussed above, the illustrated configurable core profile should not be considered limiting. In particular, although it is preferred that the pair separator is supplied as a flat extruded tape, the configurable pair separator may be made by a process other than extrusion and may have a number of different shapes or provide a number of different channels, as is illustrated by some of the embodiments described in further detail below.

Referring again to FIG. 6, the data communications cable may also be provided with a binder 19, as illustrated in phantom, that is wrapped around the configurable core pair separator 14 and the plurality of twisted pairs 12. For this embodiment, it is preferable that the configurable core pair separator be an aluminum/mylar tape, with an aluminum layer on a side of the tape facing the plurality of twisted pairs. In addition, it is preferred that the binder be made of the aluminum/mylar tape, with the aluminum layer of the tape facing the plurality of the twisted pairs so that the combination of the binder and the configurable pair separator provide four electrically shielded, enclosed channels. With this embodiment, the four enclosed channels are isolated from one another to provide desired crosstalk isolation. In addition, another benefit of the embodiment of the cable is that a cable adjacent this cable will have reduced coupling with the cable of the invention, or in other words, reduced alien cross talk as it is known in the industry.

The embodiment of FIG. 6 further illustrates a shield 21 may also be laterally wrapped around the binder 19; the shield is preferably made from a foil or metal. The shield may be applied over the cable before jacketing the cable with the jacket 16, and is also used to help reduce crosstalk between the twisted pairs, to reduce alien crosstalk, and prevent the cable from causing or receiving electromagnetic interference. It is to be appreciated that the shield can also be provided in lieu of the binder. In particular, greater crosstalk isolation between the twisted pairs of the cable, and reduced alien crosstalk may also be achieved by using a conductive shield 21 that is, for example, a metal braid, a solid metal foil, or a conductive plastic that is in contact with ends of the protrusions 17 of the configurable filler 14. If the configurable pair separator is also conductive or semi-conductive as described above for the aluminum/mylar tape, then the combination of the pair separator and the shield forms conductive compartments that shield each twisted pair from the other twisted pairs.

Referring to FIG. 6, the cable can advantageously include a metal drain wire 23 exposed, for example, within the middle of the configurable pair separator 14. The metal drain wire runs the length of the cable and acts as a ground. However, it is to be appreciated that the metal drain wire need not be so placed and may also be arranged in arrangements known to those of skill in the art such as, for example, spirally wrapped around the binder 19 or the shield 21.

It is preferable in the embodiments described herein that the protrusions 17 of the configurable pair separator extend at least beyond a center axis of each twisted pair, known in the art as a pitch radius. The pitch radius is illustrated in FIG. 6 as the radius R between the center of the cable core and the center axis of the twisted pairs 12 of conductors. This preferred configuration of the configurable pair separator ensures that the twisted pairs do not escape their respective spaces or channels. It is also to be appreciated that the process of jacketing of the cable, to be described in detail below, may bend the ends of the protrusions 17 over slightly (not illustrated), since the configurable pair separator is relatively formable.

Figure 7:
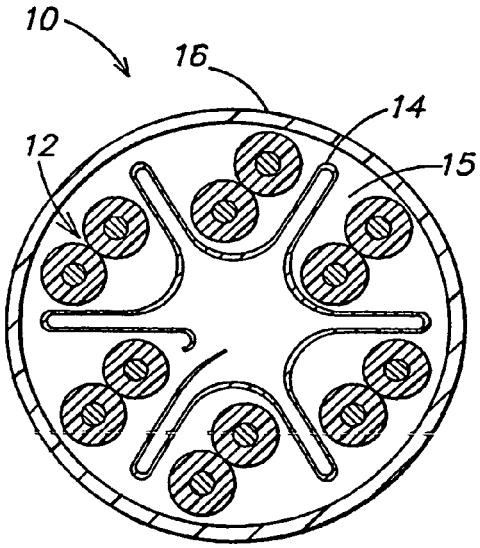
FIG. 7 is a cross-sectional view of a data communications cable according to another embodiment of the invention.

As discussed above, it is to be appreciated that the twisted pairs of insulated conductors and configurable pair separator of the communications data cable of the invention, can be configured in a variety of ways. FIGS. 7–12 depict cross-sectional views of various embodiments of the data communications cable of the invention. As illustrated, for example, in FIGS. 7, 9 and 10, the configurable pair separator may be configured such that the grooves 15 do not form completely enclosed channels. FIG. 7 depicts a cable 10 wherein six twisted pairs 12 are encased within the jacket assembly 16, and are separated from each other by the configurable pair separator 14. The pair separator 14 is configured in a somewhat "*" shape that provides support and placement of the twisted pairs so that the twisted pairs 12 have a desired spacial arrangement and do not come into direct physical contact with each other.

Figure 8:
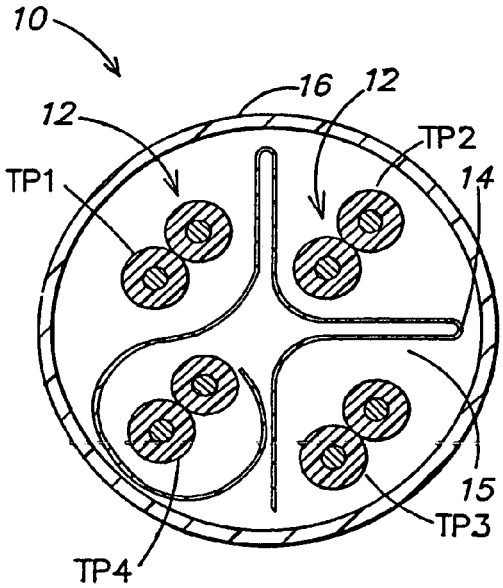
FIG. 8 is a cross-sectional view of a data communications cable according to another embodiment of the invention.

FIG. 8 depicts still another embodiment of the data communications cable 10 having multiple twisted pairs 12 encased within the jacket assembly 16 and having at least one of the twisted pairs isolated by the pair separator 14, from the remainder of the twisted pairs. In particular, referring to FIG. 8, the twisted pairs have been labeled TP1, TP2, TP3 and TP4, wherein twisted pair TP4 is isolated from twisted pairs TP1, TP2 and TP3 by the pair separator 14. It is an advantage of this embodiment, that the pair separator 14 can be provided with an appropriate number of twists or wrappings around the twisted pair TP4, so as to provide selective isolation between twisted pair TP4 and twisted pairs TP1, TP2 and TP3. This embodiment of the cable according to the invention can be used, for example, to provide better isolation between a weakest one or a weakest combination of twisted pairs of cables, in an environment where there is known to be a low amount of isolation between a particular twisted pair and another twisted pair, or a plurality of twisted pairs. Accordingly, with this embodiment of the cable of the invention, there can be selective enhancement of isolation between twisted pairs TP1-TP4, TP2-TP4, and TP3-TP4. It is to be appreciated that although the twisted pair TP4 has been illustrated as being isolated from the remainder of the twisted pairs, that any of the twisted pairs can be so wrapped with the filler and isolated. This embodiment of the invention may also be used in conjunction with a lessening of the twist lays requirements for the twisted pairs, to provide cable having a same amount of isolation between twisted pairs as a cable with tighter twist lays. Accordingly, this embodiment of the cable according to the invention allows for selective design of isolation between particular twisted pairs of the cable and lessening of the twist lay requirements for the cable.

Figure 9:
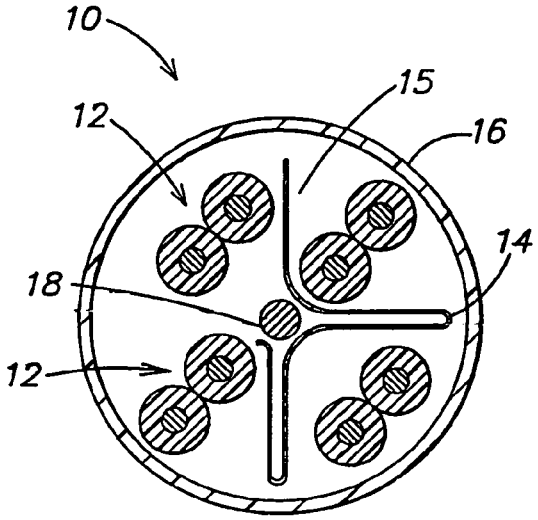
FIG. 9 is a cross-sectional view of a data communications cable according to another embodiment of the invention.

FIG. 9 depicts still another embodiment of the data communications cable 10 having multiple twisted pairs 12 encased within the jacket assembly 16 and physically separated from each other by the configurable pair separator 14, and also including a central core filler 18 positioned at the middle of the cable and that runs along the longitudinal length of the cable, provided less than 100% of the core is filled with the filler. The configurable pair separator provides desired separation between the individual twisted pairs 12 as discussed above. The central core 18 provides additional support or structure and may be formed of, for example, a solid or foamed flame retardant polyolefin or other materials that are known in the industry. For plenum rated cables, it is preferable that the core be any of one or more of the following compounds: a solid low-dielectric constant fluoropolymer, e.g. ethylene chlorotrifluoroethylene (E-CTFE), FEP, a foamed fluoropolymer, e.g. foamed FEP, and PVC in either solid, low dielectric constant form or foamed. The central core filling 18 may also be constructed of the same materials as the configurable pair separator 14 discussed above.

Figure 1:
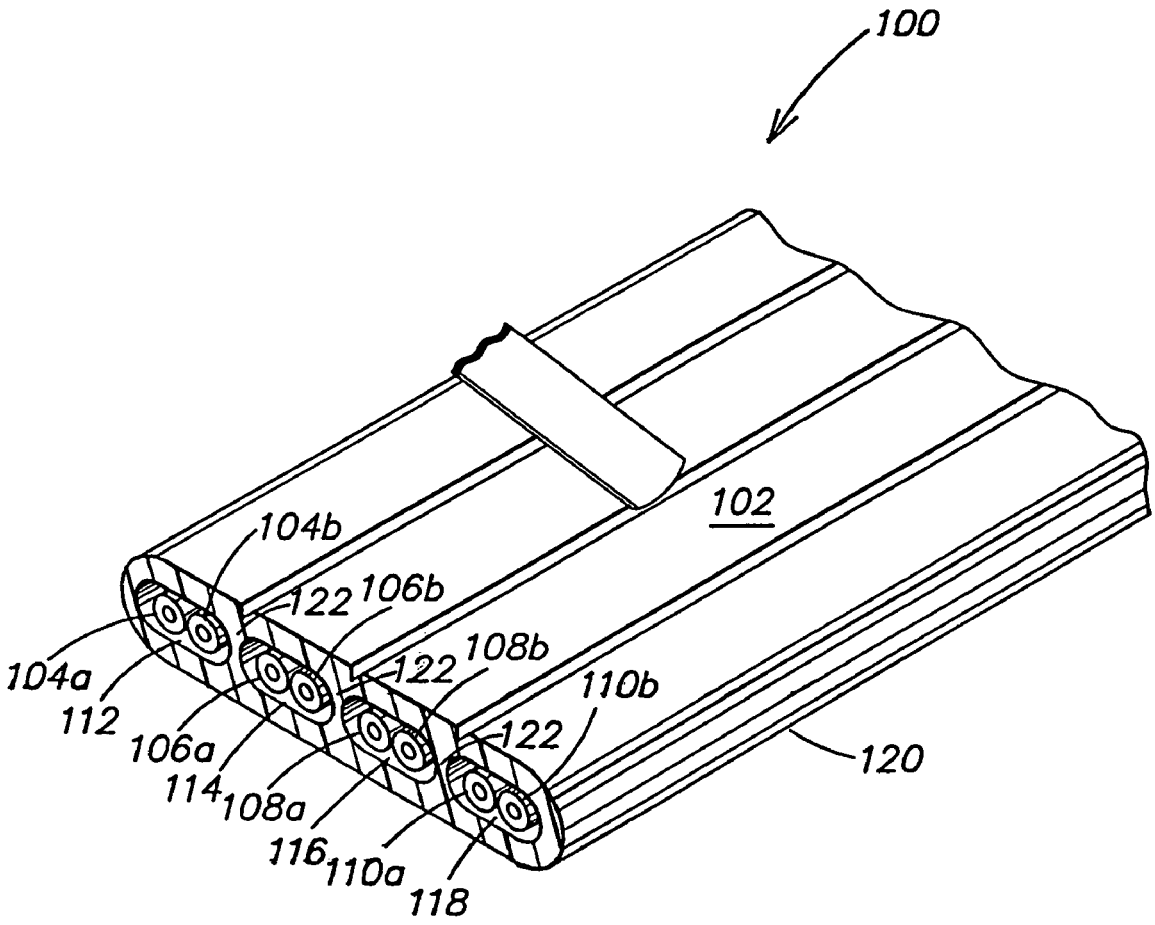
FIG. 1 (RELATED ART)
FIG. 1 is a perspective view of an embodiment of a communications cable according to the related art.
Figure 2:
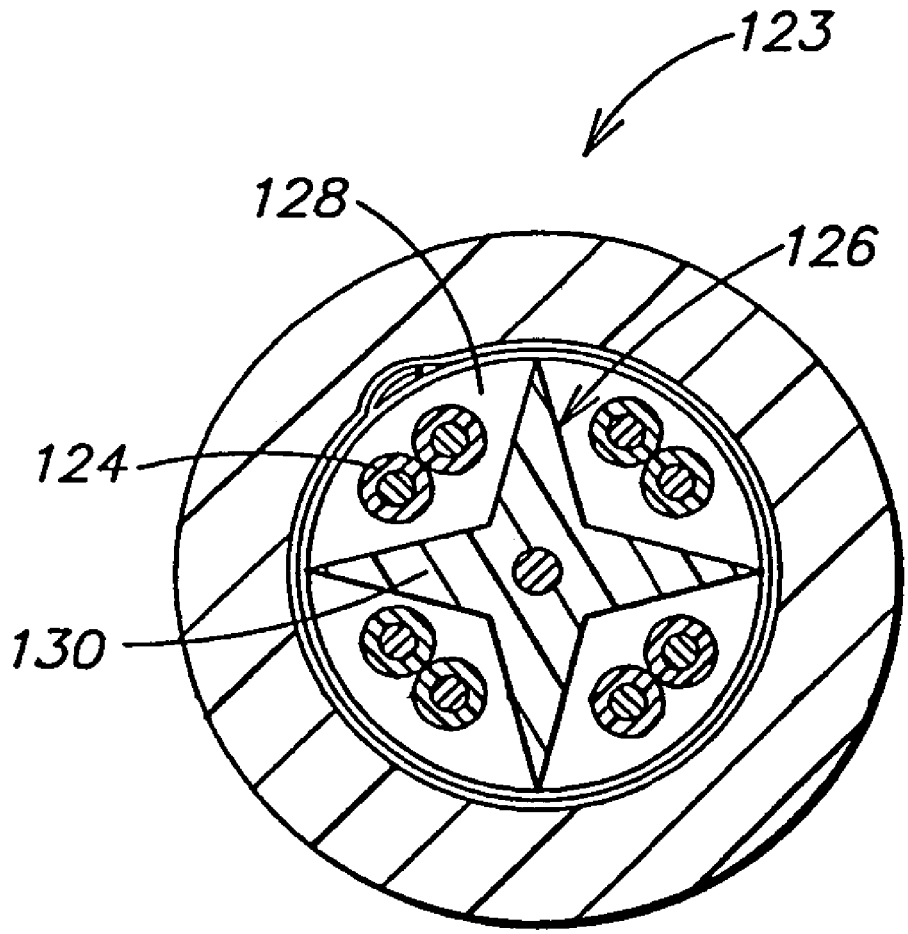
FIG. 2 (RELATED ART)
FIG. 2 is a cross-sectional view of another embodiment of a communications cable according to the related art.
Figure 3:
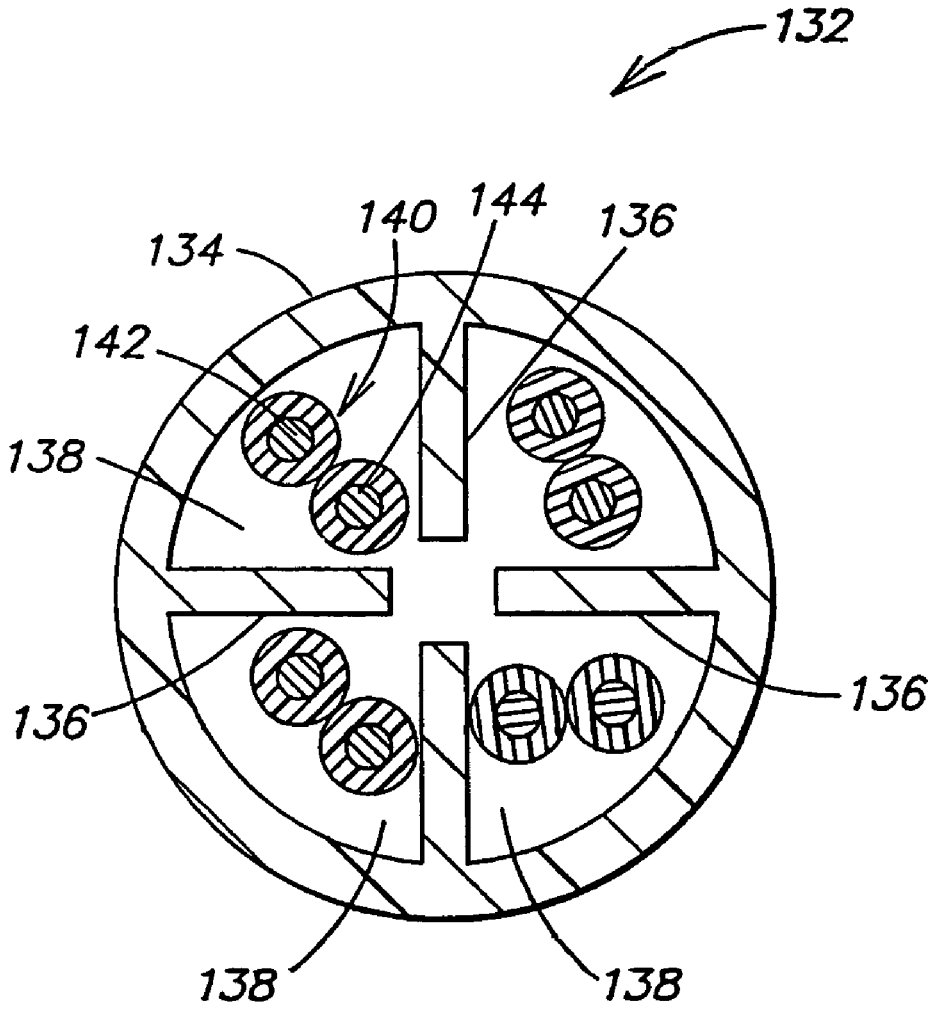
FIG. 3 (RELATED ART)
FIG. 3 is a cross-sectional view of another embodiment of a communications cable according to the related art.
Figure 10:
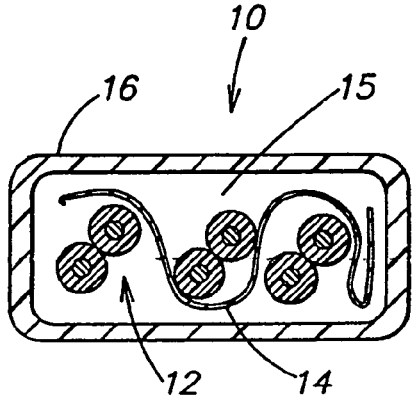
FIG. 10 is a cross-sectional view of a data communications cable according to another embodiment of the invention.

FIG. 10 depicts yet another embodiment of a data communications cable 10, having a substantially flat configuration. Twisted pairs 12 are encased within a substantially flat jacket assembly 16 and physically separated from each other by the configurable pair separator 14. The cable of FIG. 10 is an alternative to the cable of the related art as illustrated in FIG. 1, and other known flat cables. It is to be understood, that although this embodiment is illustrated with a single fold of the pair separator material between each twisted pair, that the number of folds can be increased to further adjust the distance between each of the twisted pairs and thereby increase the isolation between each of the twisted pairs. Other variations known to those of skill in the art are also intended to be within the scope of the invention and this embodiment. For example, the pair separator may also be disposed at a bottom of the cable with folds directed upwardly towards the top of the cable, in contrast to at the top of the cable with the folds directed towards the bottom of the cable as illustrated in FIG. 10, or the pair separator may be disposed at both the bottom and top.

Figure 11:
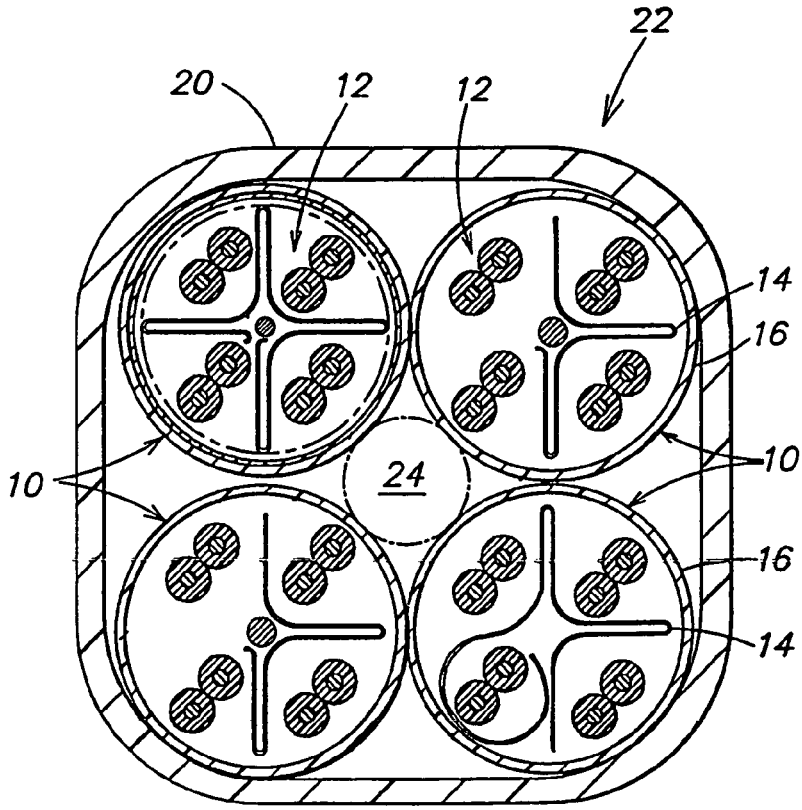
FIG. 11 is a cross-sectional view of a data communications cable according to another embodiment of the invention.

FIG. 11 depicts an embodiment of a data communications cable 22 including a plurality of data communications cables 10 according to any of the embodiments described above. In particular, each data cable 10 contains multiple twisted pairs 12 separated by the configurable pair separator 14 according to any of the above-described configurations, and encased in the jacket assembly 16. The plurality of data cables are enclosed within outer casing 20. The cable 22 may also have a central core filler 24, as illustrated in phantom, that may be formed from any of the above-described materials and may be used to, for example, to keep the data cables in a desired arrangement so as to, for example, minimize crosstalk between each of the data cables 10.

Figure 12:
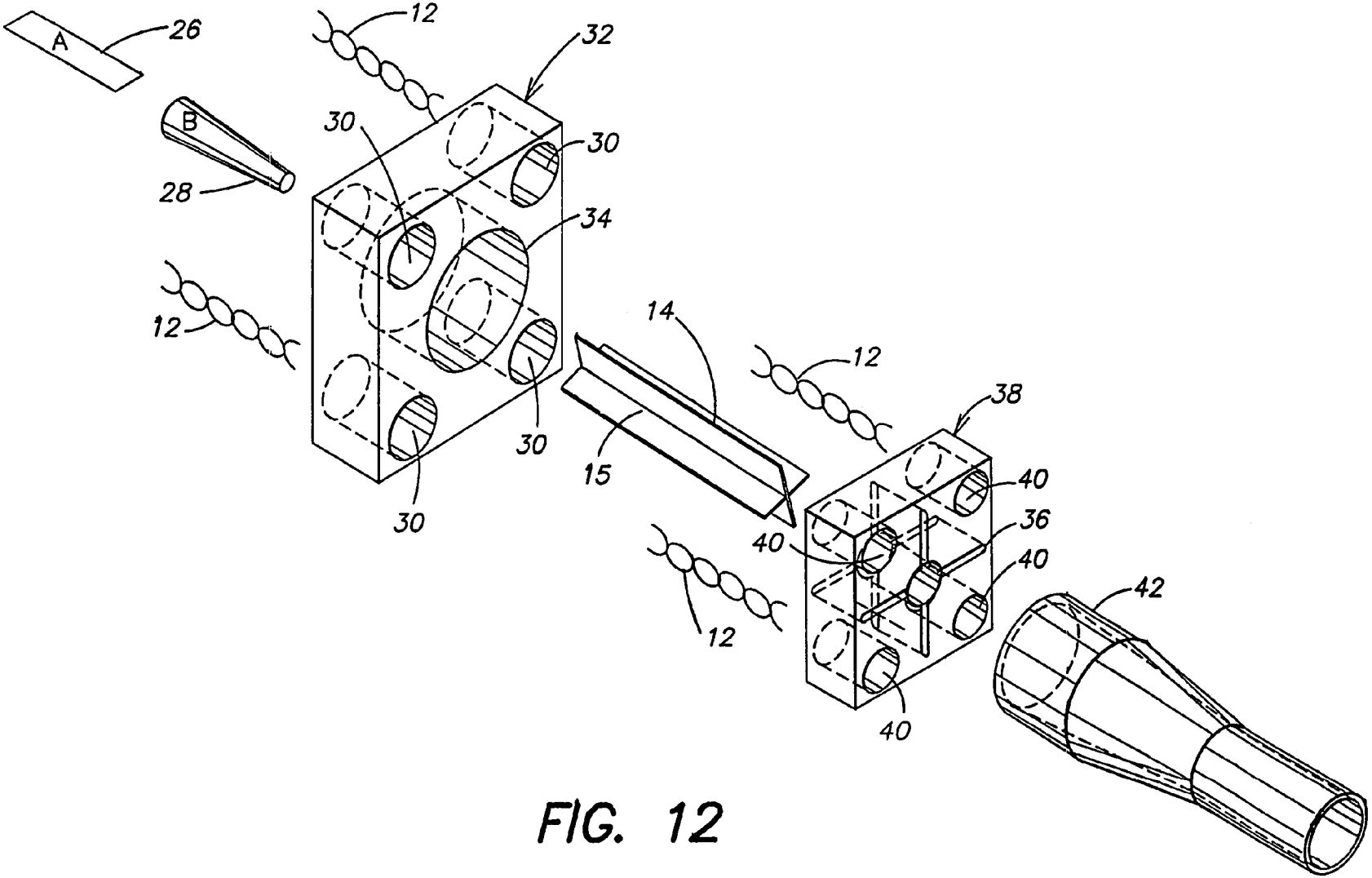
FIG. 12 is a perspective view of a system for practicing a method of making a cable in accordance with an embodiment of the invention.

Referring now to FIG. 12, there is illustrated a perspective view of a system for practicing a method of making a cable in accordance with an embodiment of the invention. The pair separator 26 is drawn from a reel or pad (not shown), and is formed around a round cob 28 into a shaped pair separator such as, for example, in the shape of a cylinder. The shaped pair separator is aligned with four twisted pairs 12 by passing the four twisted pairs through openings 30 in first die 32, and the shaped pair separator through central opening 34. The shaped pair separator is then further configured into a desired shape (formed pair separator) as illustrated in FIG. 12. It is to be appreciated, as discussed above, that this shape can be varied. The formed pair separator 15 is then passed through opening 36 in second die 38 and brought together with the four twisted pairs 12 which are passed through corresponding openings 40 in the second die. The plurality of twisted pairs are then cabled with the formed pair separator by a third die 42, in an operation referred to as "bunching". The third die places the twisted pairs in the channels 15 (see FIGS. 5–10) of the formed pair separator prior to twisting of the cable. It is to be appreciated that the cable can be twisted with any known twisting arrangement such as a helix, or an S-Z configuration. It is also to be appreciated that this method can be varied to include any of the components illustrated and discussed above, such as, for example, to include a drain wire, a binder, a shield, or central core filler.

Accordingly, some of the advantages of the various embodiments of the data communications cable of the invention are crosstalk performance and isolation enhancement can be configured and provided as customized cable solutions for hardware manufactures who request special requirements. For example, specific twisted pair combinations can receive a dedicated amount of isolation tape folds, thereby enhancing separation of selected twisted pairs and enhancing crosstalk isolation between the selected twisted pairs where an end user, for example, needs more crosstalk isolation. The data communications cable can also be made with a desired crosstalk isolation between the opposing twisted pairs of insulated conductors. In addition, due to the conforming nature and the thickness of the pair separator material, this advantage does not come at the expense of, for example, the size of the data communications cable, and does not result in a reduced impedance stability of the data communications cable. Another advantage is that the amorphous nature of the pair separator yields a desired cable that better facilitates termination of the data communications cable to known industry hardware, than larger diameter cables of the related art.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. An unshielded twisted pair communications cable comprising:

a plurality of twisted pairs of insulated conductors including a first twisted pair of insulated conductors and a second twisted pair of insulated conductors;

a configurable tape separator disposed between the plurality of twisted pairs of conductors in the unshielded twisted pair communications cable and arranged so as to separate the first twisted pair of insulated conductors from the second twisted pair of insulated conductors; and a jacket enclosing the plurality of twisted pairs of insulated conductors and the configurable tape separator;

wherein the plurality of twisted pairs of insulated conductors and the configurable tape separator are cabled about a common axis to form the unshielded twisted pair communications cable; and wherein the configurable tape separator is substantially non-conductive.

2. The unshielded twisted pair communications cable as claimed in claim 1, wherein the configurable pair separator is arranged so as to define at least two channels and wherein the first twisted pair of insulated conductors is disposed at least partially within a first channel and the second twisted pair of insulated conductors is disposed at least partially within a second channel.

3. The unshielded twisted pair communications cable as claimed in claim 1, wherein, prior to cabling, the configurable tape separator comprises a substantially flat tape.

4. The unshielded twisted pair communications cable as claimed in claim 3, wherein, after cabling, the configurable tape separator is arranged so as to provide at least one concave surface defining a channel, and wherein the first twisted pair of insulated conductors is disposed at least partially within the channel.

5. The unshielded twisted pair communications cable as claimed in claim 1, wherein the separator is constructed such that when a portion of the jacket is removed from an end of the cable to expose the plurality of twisted pairs and the separator, the exposed separator is substantially flat.

6. The unshielded twisted pair communications cable as claimed in claim 1, wherein the configurable tape separator occupies less than approximately 50% of a core area between the plurality of twisted pairs of insulated conductors.

7. The unshielded twisted pair communications cable as claimed in claim 1, wherein the configurable tape separator occupies approximately 32% of a core area of the cable between the plurality of twisted pairs of insulated conductors.

8. The unshielded twisted pair communications cable as claimed in claim 1, wherein the configurable tape separator includes a foamed polymer.

9. The unshielded twisted pair communications cable as claimed in claim 1, wherein the configurable tape separator includes a woven fiberglass tape.

10. The unshielded twisted pair communications cable as claimed in claim 1, wherein the cable is suitable for plenum applications and wherein the configurable tape separator comprises at least one of a solid low-dielectric constant fluoropolymer, fluoroethylenepropylene, a foamed fluoropolymer, and polyvinyl chloride.

11. The unshielded twisted pair communications cable as claimed in claim 1, wherein the configurable tape separator includes a flame-retardant, low-dielectric constant, foamed polymer tape.

12. The unshielded twisted pair communications cable as claimed in claim 11, wherein the configurable tape separator comprises at least one of a foamed flame-retardant cellular polyolefin, a foamed flame-retardant fluoropolymer material, foamed fluorinated ethylene propylene, and foamed polyvinyl chloride.

13. The unshielded twisted pair communications cable as claimed in claim 1, wherein the configurable tape separator is disposed so as to prevent direct physical contact between the first twisted pair and the jacket.

14. An unshielded twisted pair communications cable comprising:

a plurality of twisted pairs of insulated conductors including a first twisted pair of insulated conductors and a second twisted pair of insulated conductors;

a configurable pair separator that, prior to cabling, comprises a substantially flat, non-conductive tape disposed between the plurality of twisted pairs of conductors and that is arranged so as to separate the first twisted pair of insulated conductors from the second twisted pair of insulated conductors; and a jacket enclosing the plurality of twisted pairs of insulated conductors and the configurable pair separator;

wherein the plurality of twisted pairs of insulated conductors and the configurable pair separator are cabled about a common axis to form the unshielded twisted pair communications cable.

15. The unshielded twisted pair communications cable as claimed in claim 14, wherein, after cabling, the configurable pair separator is arranged so as to provide at least two channels, and wherein the first twisted pair of insulated conductors is disposed at least partially within a first channel and the second twisted pair of insulated conductors is disposed at least partially within a second channel.

16. The unshielded twisted pair communications cable as claimed in claim 14, wherein the configurable pair separator occupies less than approximately 50% of a core area between the plurality of twisted pairs of insulated conductors.

17. The unshielded twisted pair communications cable as claimed in claim 14, wherein the configurable pair separator includes a foamed polymer.

18. The unshielded twisted pair communications cable as claimed in claim 14, wherein the configurable pair separator includes a woven fiberglass tape.

19. The unshielded twisted pair communications cable as claimed in claim 14, wherein the configurable pair separator comprises at least one of a foamed flame-retardant cellular polyolefin, a foamed flame-retardant fluoropolymer material, foamed fluorinated ethylene propylene, and a foamed polyvinyl chloride.

20. An unshielded twisted pair communications cable comprising:

a plurality of twisted pairs of insulated conductors including a first twisted pair and a second twisted pair;

a separator disposed among the plurality of twisted pairs of insulated conductors so as to separate the first twisted pair from the second twisted pair; and a jacket enclosing the plurality of twisted pairs of insulated conductors and the separator;

wherein the separator is substantially non-conductive and is constructed such that, when a portion of the jacket is removed from an end of the cable to expose the plurality of twisted pairs and the separator, the exposed separator is substantially flat.

* * * * *